US010529281B2

(12) United States Patent
Wang

(10) Patent No.: US 10,529,281 B2
(45) Date of Patent: Jan. 7, 2020

(54) PIXEL COMPENSATION CIRCUIT AND DISPLAY DEVICE

(71) Applicant: EVERDISPLAY OPTRONICS (SHANGHAI) LIMITED, Shanghai (CN)

(72) Inventor: Jiangang Wang, Shanghai (CN)

(73) Assignee: EverDisplay Optronics (Shanghai) Limited, Shanghai (CN)

( * ) Notice: Subject to any disclaimer, the term of this patent is extended or adjusted under 35 U.S.C. 154(b) by 537 days.

(21) Appl. No.: 15/165,871

(22) Filed: May 26, 2016

(65) Prior Publication Data

US 2017/0236469 A1 Aug. 17, 2017

(30) Foreign Application Priority Data

Feb. 17, 2016 (CN) ..... 2016 1 0088296

(51) Int. Cl.
*G09G 3/3233* (2016.01)

(52) U.S. Cl.
CPC ... *G09G 3/3233* (2013.01); *G09G 2300/0842* (2013.01); *G09G 2300/0871* (2013.01); *G09G 2310/0218* (2013.01); *G09G 2320/0233* (2013.01)

(58) Field of Classification Search
CPC ... G09G 2300/0842; G09G 2300/0871; G09G 2310/0218; G09G 2320/0233; G09G 3/3233
See application file for complete search history.

(56) References Cited

U.S. PATENT DOCUMENTS 7,202,606 B2 * 4/2007 Eom ..... G09G 3/3233 315/169.3
2005/0243037 A1 * 11/2005 Eom ..... G09G 3/3233 345/76

(Continued)

FOREIGN PATENT DOCUMENTS

CN 103927975 A 7/2014
CN 104318894 A 1/2015

(Continued)

OTHER PUBLICATIONS

The CN1OA issued by CNIPA dated Oct. 15, 2018.

*Primary Examiner* — Dmitriy Bolotin
(74) *Attorney, Agent, or Firm* — Yunling Ren

(57) ABSTRACT

The present disclosure relates to a pixel compensation circuit and display device. The circuit includes: first to fifth switching elements, a storage capacitor, and a driving element. Each of the first to fifth switching elements and the driving element has a control terminal, a first terminal and a second terminal. The storage capacitor has first and second terminals. The control terminals of the first and second switching elements are coupled to an output terminal for outputting an n-th gate driving signal, the control terminals of the third and fourth switching elements are coupled to an output terminal for outputting an enabling signal, the control terminal of the fifth switching element is coupled to an output terminal for outputting an (n−1)-th gate driving signal, the control terminal of the driving element is coupled to the second node, and the storage capacitor is coupled between the first and second nodes.

15 Claims, 10 Drawing Sheets

(56) References Cited

U.S. PATENT DOCUMENTS

| | | | | |
|---|---|---|---|---|
| 2011/0193855 | A1* | 8/2011 | Han | G09G 3/3233 345/214 |
| 2011/0193856 | A1* | 8/2011 | Han | G09G 3/3233 345/214 |
| 2014/0160179 | A1* | 6/2014 | Ishii | G09G 3/3233 345/690 |
| 2014/0292622 | A1* | 10/2014 | Lee | G09G 3/3233 345/80 |
| 2015/0364076 | A1* | 12/2015 | Park | G09G 3/2081 345/77 |
| 2016/0035282 | A1* | 2/2016 | Lu | H05B 33/0896 315/291 |
| 2016/0141350 | A1* | 5/2016 | Kim | H01L 27/3276 257/40 |
| 2016/0180772 | A1* | 6/2016 | Ma | G09G 3/3233 345/214 |
| 2016/0260380 | A1* | 9/2016 | Yang | G09G 3/32 |
| 2017/0025062 | A1* | 1/2017 | Wang | G09G 3/3233 |
| 2017/0039945 | A1* | 2/2017 | Wang | G09G 3/3258 |
| 2017/0069264 | A1* | 3/2017 | Dai | G09G 3/3233 |
| 2017/0169764 | A1* | 6/2017 | Lee | G09G 3/3291 |
| 2017/0186375 | A1* | 6/2017 | Jung | G09G 3/3233 |
| 2017/0365647 | A1* | 12/2017 | Choi | G09G 3/3233 |

FOREIGN PATENT DOCUMENTS

| | | | |
|---|---|---|---|
| CN | 104361857 | A | 2/2015 |
| CN | 104715724 | A | 6/2015 |

* cited by examiner

PIXEL COMPENSATION CIRCUIT AND DISPLAY DEVICE

CROSS-REFERENCE TO RELATED APPLICATIONS

This application claims priority to Chinese Patent Application No. 201610088296.6, filed Feb. 17, 2016, the entire contents of which are incorporated herein by reference.

TECHNICAL FIELD

The present disclosure generally relates to display technologies, and more particularly, to a pixel compensation circuit and a display device.

BACKGROUND

Presently, driver circuits in Active-Matrix Organic Light Emitting Diode (AMOLED) panels are generally manufactured using a low temperature poly-silicon process. The currently prevail low temperature poly-silicon process usually uses Excimer Laser Anneal (ELA). ELA refers to performing ELA on an a-Si thin film deposited on glass to make the a-Si thin film converted into a p-Si thin film, i.e., changing from amorphous silicon to poly-silicon. Thus, the field effect mobility of the electrons (i.e., the moving speed of the electrons) is increased by hundreds of times.

Organic Light Emitting Diodes (OLED) are current-driven elements, which means that even a small current variation can result in changes in luminance of the OLEDs, and such changes are reflected as uneven brightness. Taking an AMOLED panel constructed using PMOS transistors as an example, FIG. 1 is a schematic diagram showing a pixel compensation circuit in an OLED driver circuit in related arts. When the OLED emits light, the current $I_{OLED}$ flowing through the OLED is calculated based on the following equation:

$$I_{OLED}=\tfrac{1}{2}C_{ox}u\ W/L(V_{GS}-Vth)^2$$

where $C_{ox}$ is capacitance of gate oxide layer per unit area of the transistor, u is a channel carrier mobility of the transistor, W/L is a ratio between a width and a length of the channel of the transistor, $V_{GS}$ is a voltage between a gate and a source of the transistor, and Vth is a threshold voltage which enables a driving transistor for driving the OLED to be conducted.

If low temperature poly-silicon is manufactured using ELA, uneven energy control may occur during the ELA process. Thus, the thin film formed by the amorphous silicon is uneven, and the resulted poly-silicon grains are not of uniform size. Consequently, the threshold voltages Vth for enabling the products to be conducted are not uniform. As can be seen from the above equation for calculating $I_{OLED}$, the light emitting current of OLED is sensitive to the threshold voltage Vth of the driving transistor, and if the Vth is shifted, the current flowing through the OLED will change exponentially. Also, since the light emitting current of the OLED directly influences the luminance of the OLED, the luminance of the AMOLED panel becomes uneven and thereby display defects occur.

SUMMARY

Aiming at the defects existing in conventional technologies, embodiments of the present disclosure provide a pixel compensation circuit and a display device in order to address the problem that the luminance of the AMOLED panel becomes uneven and thereby display defects occur due to Vth shift.

Embodiments of the present disclosure provides a pixel compensation circuit, including:

a first switching element having a control terminal coupled to an output terminal for outputting an n-th gate driving signal, a first terminal coupled to an output terminal for outputting a data voltage, and a second terminal coupled to a first node;

a driving element having a control terminal coupled to a second node, a first terminal coupled to a first power voltage, and a second terminal coupled to a third node;

a storage capacitor coupled between the first node and the second node;

a second switching element having a control terminal coupled to the output terminal for outputting the n-th gate driving signal, a first terminal coupled to the second node, a second terminal coupled to the third node;

a third switching element having a control terminal coupled to an output terminal for outputting an enabling signal, a first terminal receiving the first voltage, and a second terminal coupled to the first node;

a fourth switching element having a control terminal coupled to the output terminal for outputting the enabling signal, a first terminal coupled to the third node; and a fifth switching element having a control terminal coupled to an output terminal for outputting an (n−1)-th gate driving signal, and a first terminal coupled to the second node, wherein n is a positive integer greater than 1.

In an embodiment of the present disclosure, the fifth switching element has a second terminal coupled to the control terminal of the fifth switching element.

In another embodiment of the present disclosure, the fifth switching element has a second terminal receiving an initialization voltage.

In another embodiment of the present disclosure, the first to fifth switching elements are first to fifth transistors, respectively, and the driving element is a driving transistor.

In another embodiment of the present disclosure, the first to fifth transistors and the driving transistor are PMOS transistors.

In another embodiment of the present disclosure, the first voltage is a high level voltage and the second voltage is a low level voltage.

In another embodiment of the present disclosure, in an initialization stage:

the n-th gate driving signal and the enabling signal are at a high level, the first switching element, the second switching element, the third switching element and the fourth switching element are switched off, the (n−1)-th gate driving signal is at a low level, the fifth switching element is switched on, the second node is pulled to a low level, and the driving element is switched on.

In another embodiment of the present disclosure, in a threshold voltage shift stage:

the enabling signal and the (n−1)-th gate driving signal are at a high level, the second switching element, the third switching element and the fourth switching element are switched off, the n-th gate driving signal is at a low level, the first switching element is switched on, the data voltage is written to the first node, the second switching element is switched on, the control terminal and the second terminal of the driving element are short-circuited, a voltage at the second node is the first voltage plus a threshold voltage, wherein the threshold voltage is a voltage enabling the driving element to be conducted.

In another embodiment of the present disclosure, in a light emitting stage:

the n-th gate driving signal and the (n−1)-th gate driving signal are at a high level, the first switching element, the second switching element and the fifth switching element are switched off, the enabling signal is at a low level, the third switching element and the fourth switching element are switched on, a voltage at the first node is equal to the first voltage, a voltage at the second node is the first voltage plus a threshold voltage plus a difference between the first voltage and the data voltage, wherein the threshold voltage is a voltage enabling the driving element to be conducted.

Embodiments of the present disclosure further provide a display device, including an array substrate provided with the pixel compensation circuit as mentioned above.

Embodiments of the present disclosure further provide a pixel compensation circuit, including:

a first switching element responsive to an n-th gate driving signal to transfer a data voltage to a first node;

a driving element responsive to a voltage at a second node to transfer a first voltage to a third node;

a storage capacitor coupled between the first node and the second node;

a second switching element responsive to the n-th gate driving signal to change a voltage at the second node;

a third switching element responsive to an enabling signal to make the first voltage equal to a voltage at the first node;

a fourth switching element responsive to the enabling signal and coupled between the third node and an anode of an organic light emitting diode; and a fifth switching element responsive to an (n−1)-th gate driving signal and coupled to the second node, wherein n is a positive integer greater than 1.

In another embodiment of the present disclosure, the organic light emitting diode has a cathode coupled to a second voltage.

In another embodiment of the present disclosure, the first to fifth switching elements are first to fifth transistors, respectively, the driving element is a driving transistor, and the first to fifth transistors and the driving transistor are PMOS transistors.

In another embodiment of the present disclosure, the first voltage is a high level voltage and the second voltage is a low level voltage.

In another embodiment of the present disclosure, in an initialization stage:

the n-th gate driving signal and the enabling signal are at a high level, the first switching element, the second switching element, the third switching element and the fourth switching element are switched off, the (n−1)-th gate driving signal is at a low level, the fifth switching element is switched on, the second node is pulled to a low level, and the driving element is switched on.

In another embodiment of the present disclosure, in a threshold voltage shift stage:

the enabling signal and the (n−1)-th gate driving signal are at a high level, the second switching element, the third switching element and the fourth switching element are switched off, the n-th gate driving signal is at a low level, the first switching element is switched on, the data voltage is written to the first node, the second switching element is switched on, such that the driving element is short-circuited, a voltage at the second node is the first voltage plus a threshold voltage, wherein the threshold voltage is a voltage enabling the driving element to be conducted.

In another embodiment of the present disclosure, in a light emitting stage:

the n-th gate driving signal and the (n−1)-th gate driving signal are at a high level, the first switching element, the second switching element and the fifth switching element are switched off, the enabling signal is at a low level, the third switching element and the fourth switching element are switched on, a voltage at the first node is equal to the first voltage, a voltage at the second node is the first voltage plus a threshold voltage plus a difference between the first voltage and the data voltage.

The technical solutions provided by embodiments of the present disclosure have the following advantageous technical effects:

The pixel compensation circuit has an improved structure as compared with the conventional pixel compensation circuit. Thus, the light emitting current of the OLED is irrelevant to the threshold voltage of the driving transistor, and the direct influence of the shift of the threshold voltage on the luminance of the OLED is eliminated. Consequently, the present disclosure can prominently improve the display defects such as unevenness in image displaying due to nonuniformity in the threshold voltage for enabling the device to be conducted.

BRIEF DESCRIPTION OF THE DRAWINGS

The above and other features and advantages of the present disclosure will become clearer from detailed descriptions of exemplary embodiments with reference to drawings.

DETAILED DESCRIPTION

Figure 1:
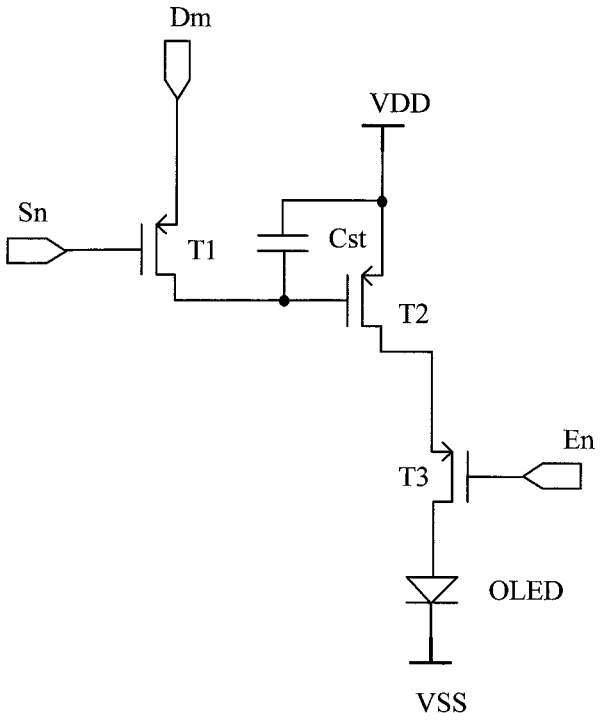
Fig. 1 (Prior Art)
FIG. 1 is a schematic diagram showing a pixel compensation circuit in an OLED driver circuit in related arts.

Typical embodiments representing features and advantages of the present disclosure will be described below in detail. It shall be appreciated that the present disclosure may have variations in different embodiments without departing from the scope of the present disclosure, and the description and drawings herein are only for illustrative purposes but not for limiting the present disclosure.

In order to address the problems in related arts, the following embodiments are provided to explain the principle of the present disclosure.

An embodiment of the present disclosure provides a pixel compensation circuit, including first to fifth switching elements, a storage capacitor and a driving element.

In the pixel compensation circuit, the first switching element is responsive to an n-th gate driving signal to transfer a data voltage to a first node; the driving element is responsive to a voltage at a second node to transfer a first voltage to a third node; the storage capacitor is coupled between the first node and the second node; the second switching element is responsive to the n-th gate driving signal to change a voltage at the second node; the third switching element is responsive to an enabling signal to make the first voltage equal to a voltage at the first node; the fourth switching element is responsive to the enabling signal and coupled between the third node and an anode of an organic light emitting diode; the fifth switching element is responsive to an (n−1)-th gate driving signal and coupled to the second node.

In an embodiment, the OLED is coupled between the fourth switching element and a second voltage, and the cathode of the OLED is coupled to the second voltage. The first voltage is a high level voltage and the second voltage is a low level voltage.

It shall be noted that, in the embodiment, the first to fifth switching elements are first to fifth transistors, respectively, the driving element is a driving transistor, and the first to fifth transistors and the driving transistor are PMOS transistors.

The operation procedure of the pixel compensation circuit can be divided into an initialization stage, a threshold voltage shift stage and a light emitting stage. The operation status of the circuit in the third operation stages are as follows.

In the initialization stage, the n-th gate driving signal and the enabling signal are at a high level, the first switching element, the second switching element, the third switching element and the fourth switching element are switched off, the (n−1)-th gate driving signal is at a low level, the fifth switching element is switched on, the second node is pulled to a low level, and the driving element is switched on.

In the threshold voltage shift stage, the enabling signal and the (n−1)-th gate driving signal are at a high level, the second switching element, the third switching element and the fourth switching element are switched off, the n-th gate driving signal is at a low level, the first switching element is switched on, the data voltage is written to the first node, the second switching element is switched on, such that the driving element is short-circuited, a voltage at the second node is the first voltage plus a threshold voltage, wherein the threshold voltage is a voltage enabling the driving element to be conducted.

In the light emitting stage, the n-th gate driving signal and the (n−1)-th gate driving signal are at a high level, the first switching element, the second switching element and the fifth switching element are switched off, the enabling signal is at a low level, the third switching element and the fourth switching element are switched on, a voltage at the first node is equal to the first voltage, a voltage at the second node is the first voltage plus a threshold voltage plus a difference between the first voltage and the data voltage.

In order to implement the function of the pixel compensation circuit in the above embodiment, the present disclosure further provide the following embodiment to show specific implantations of the circuit.

An embodiment of the present disclosure provides a pixel compensation circuit, including first to fifth switching elements, a storage capacitor, and a driving element. Each of the first to fifth switching elements and the driving element has a control terminal, a first terminal and a second terminal, and the storage capacitor has a first terminal and a second terminal.

The control terminal of the first switching element is coupled to an output terminal for outputting an n-th gate driving signal, a first terminal of the first switching element is coupled to an output terminal for outputting a data voltage, and a second terminal of the first switching element is coupled to a first node. A control terminal of the driving element is coupled to a second node, a first terminal of the driving element is coupled to a first power voltage, and a second terminal of the driving element is coupled to a third node. The storage capacitor is coupled between the first node and the second node. A control terminal of the second switching element is coupled to the output terminal for outputting the n-th gate driving signal, a first terminal of the second switching element is coupled to the second node, and a second terminal of the second switching element is coupled to the third node. A control terminal of the third switching element is coupled to an output terminal for outputting an enabling signal, a first terminal of the third switching element is coupled to the first voltage, and a second terminal of the third switching element is coupled to the first node. A control terminal of a fourth switching element is coupled to the output terminal for outputting the enabling signal, and a first terminal of the fourth switching element is coupled to the third node. An anode of the OLED is coupled to the second terminal of the fourth switching element, and a cathode of the OLED is coupled to a second voltage. A control terminal of the fifth switching element is coupled to an output terminal for outputting an (n−1)-th gate driving signal, and a first terminal of the fifth switching element is coupled to the second node.

In the embodiment, the first to fifth switching elements are transistors, i.e., first to fifth transistors. In other embodiments of the present disclosure, the first to fifth switching elements may be other types of switches, for example, Bipolar Junction Transistor (BIT), and the like. No matter the switching elements are switching transistors or BJTs, the driving element is a driving transistor.

In the embodiment, for example, the first to fifth transistors and the driving transistor are PMOS transistors, and the control terminal, the first terminal and the second terminal of each of the switching elements and the driving element correspond to a gate, a source and a drain, of each transistor, respectively.

Figure 2:
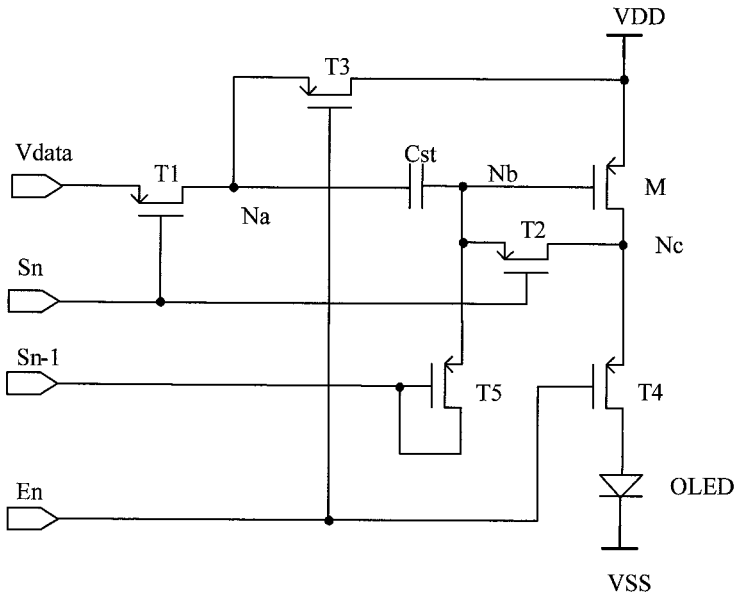
FIG. 2 is a schematic diagram showing a pixel compensation circuit according to an embodiment of the present disclosure.

The following description will be made with an example where the switching elements are transistors. FIG. 2 is a schematic diagram showing a pixel compensation circuit provided by an embodiment of the present disclosure. The connection relationships are as follows.

A control terminal of the first transistor T1 is coupled to an output terminal for outputting an n-th gate driving signal Sn, a first terminal of the first transistor T1 is coupled to an output terminal for outputting a data voltage Vdata, and a second terminal of the first transistor T1 is coupled to a first node Na. A control terminal of the driving transistor M is coupled to a second node Nb, a first terminal of the driving transistor M receives a first voltage VDD, and a second terminal of the driving transistor M is coupled to a third node Nc. The storage capacitor Cst is coupled between the first node Na and the second node Nb. Specifically, a first terminal of the storage capacitor Cst is coupled to the first node Na, and a second terminal of the storage capacitor Cst is coupled to the second node Nb. A control terminal of the second transistor T2 is coupled to the output terminal for outputting the n-th gate driving signal Sn, a first terminal of the second transistor T2 is coupled to the second node Nb, and a second terminal of the second transistor T2 is coupled to the third node Nc. A control terminal of the third transistor T3 is coupled to an output terminal for outputting an enabling signal En, a first terminal of the third transistor T3 receives the first voltage VDD, and a second terminal of the third transistor T3 is coupled to the first node Na. A control terminal of the fourth transistor T4 is coupled to the output terminal for outputting the enabling signal En, a first terminal of the fourth transistor T4 is coupled to the third node Nc, and a second terminal of the fourth transistor T4 is coupled to an anode of an OLED. A control terminal of the fifth transistor T5 is coupled to an output terminal for outputting an (n−1)-th gate driving signal Sn-1, a first terminal of the fifth transistor T5 is coupled to the second node Nb, and a second terminal of the fifth transistor T5 is coupled to the control terminal of the fifth transistor T5. A cathode of the OLED is coupled to a second voltage VSS.

In the circuit diagram shown in FIG. 2, three switching signals (i.e., a n-th gate driving signal Sn, an enabling signal En, and an (n−1)-th gate driving signal Sn-1), one data voltage Vdata and power supplies required by normal operation of the OELD (including a first voltage VDD and a second voltage VSS) are needed. When the first transistor T1 is switched on, the data voltage Vdata is written into a subpixel unit, and the voltage at the control terminal of the driving transistor M is determined by the threshold voltage Vth of the driving transistor itself and the voltage signal written by the data voltage Vdata. The first terminal of the driving transistor M receives the first voltage VDD, and a voltage difference between the control terminal and the second terminal of the second transistor T2 determines the amplitude of the current flowing through the first terminal (i.e., the source) and the second terminal (i.e., the drain) of the second transistor T2, and thereby determines the luminance of the OLED. When the second transistor T2 is switched on, the second node Nb and the second terminal (i.e., the drain) of the driving transistor M are conducted, and the first terminal (i.e., the source) and the second terminal (i.e., the drain) of the third transistor T3 are connected to the first voltage VDD and the first node Na, respectively. The first terminal (i.e., the source) and the second terminal (i.e., the drain) of the fourth transistor T4 are connected to the second terminal of the driving transistor M and the anode of the OLED, respectively. The first terminal (i.e., the source) of the fifth transistor T5 is connected to the second node Nb, and the control terminal (i.e., the gate) and the second terminal (i.e., the drain) of the fifth transistor T5 are coupled with each other to serve as a diode.

It shall be noted that in the embodiment the first voltage VDD is a high level voltage, and the second voltage VSS is a low level voltage.

Figure 3:
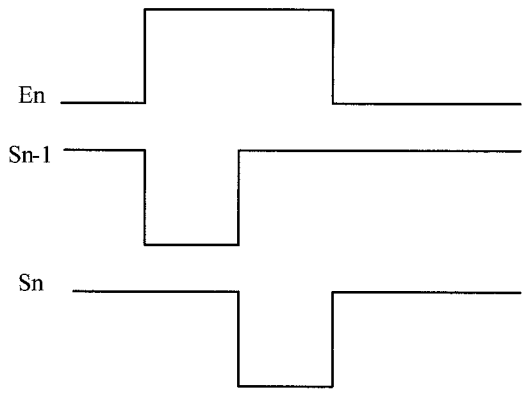
FIG. 3 is a waveform graph showing timing of three switching signals involved in the present disclosure.

FIG. 3 is a waveform graph showing timing of three switching signals involved in the embodiment.

The three operation stages, i.e., the initialization stage, the threshold voltage shift stage and the light emitting stage of the circuit as shown in FIG. 2 will be described with reference to the waveform graph in FIG. 3.

(i) Initialization Stage

Figure 4:
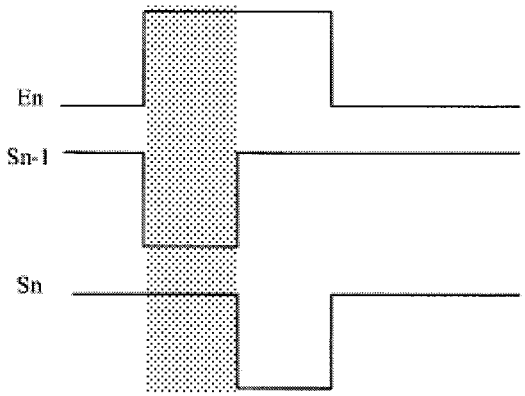
FIG. 4 is a waveform graph showing levels of the three switching signals in an initialization stage.
Figure 5:
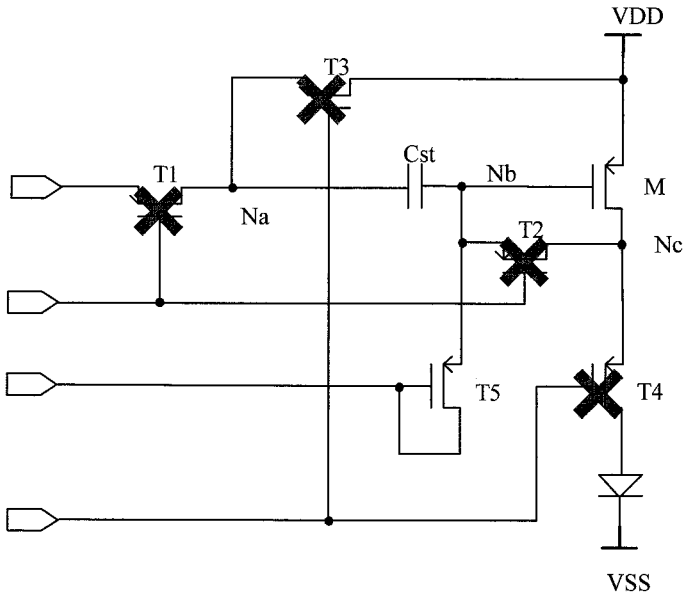
FIG. 5 is a schematic diagram showing on and off of transistors in a pixel compensation circuit in the initialization stage.

As shown in FIG. 4, the levels of the three switching signals in FIG. 3 during this stage are indicated by shadow, and corresponding on/off states of individual transistors in the circuit in FIG. 2 are shown in FIG. 5.

In the initialization stage, the n-th gate driving signal Sn and the enabling signal En are at a high level. Because the output terminal for outputting the n-th gate driving signal Sn is coupled to the control terminals of the first and second transistors T1 and T2, the first and second transistors T1 and T2 are switched off. Because the output terminal for outputting the enabling signal En is coupled to the control terminals of the third and fourth transistors T3 and T4, the third and fourth transistors T3 and T4 are switched off. In this stage, the (n−1)-th gate driving signal Sn-1 is at a low level, and because the output terminal for outputting the (n−1)-th gate driving signal Sn-1 is coupled to the control terminal of the fifth transistor T5, the fifth transistor T5 is switched on and the second node Nb is pulled to a low level at this time. Accordingly, because the control terminal of the driving transistor is coupled to the second node Nb, the driving transistor M is in a conducted state, and then the initialization of the circuit is completed.

(2) Threshold Voltage Shift Stage

Figure 6:
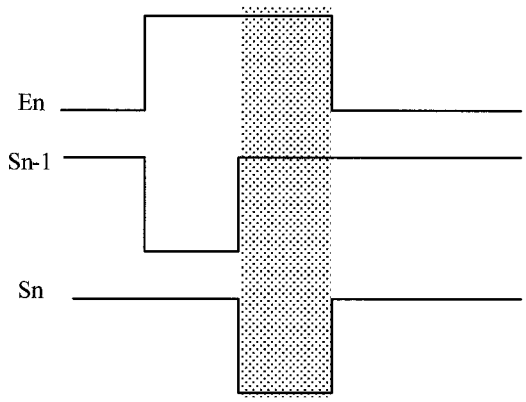
FIG. 6 is a waveform graph showing levels of the three switching signals in a threshold voltage shift stage.
Figure 7:
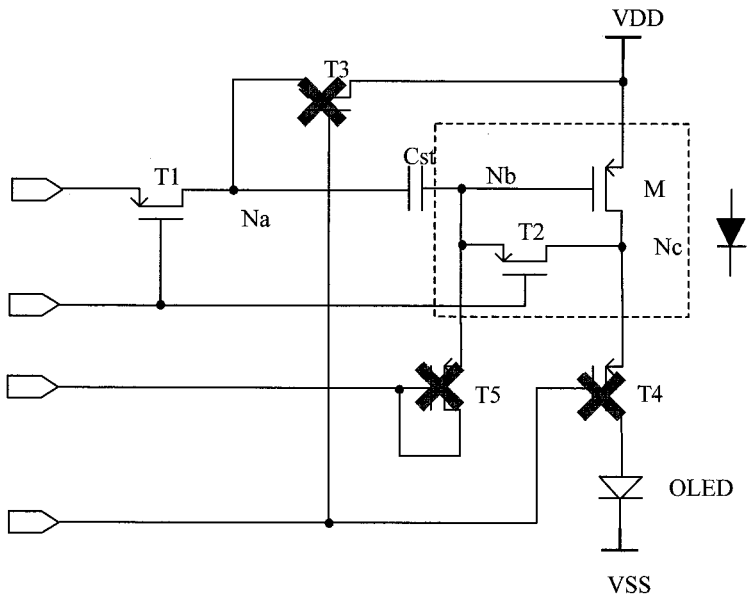
FIG. 7 is a schematic diagram showing on and off of transistors in a pixel compensation circuit in the threshold voltage shift stage.

As shown in FIG. 6, the levels of the three switching signals in FIG. 3 during this stage are indicated by shadow, and corresponding on/off states of individual transistors in the circuit in FIG. 2 are shown in FIG. 7.

In the threshold voltage shift stage, the enabling signal En and the (n−1)-th gate driving signal Sn-1 are at a high level. Because the output terminal for outputting the enabling signal En is coupled to the control terminals of the third and fourth transistors T3 and T4, the third and fourth transistors T3 and T4 keep switched off. Because the output terminal for outputting the (n−1)-th gate driving signal Sn-1 is coupled to a control terminal of the fifth transistor T5, the fifth transistor T5 is switched off. In this stage, the n-th gate driving signal Sn is at a low level, and because the output terminal for outputting the n-th gate driving signal Sn is coupled to the control terminal of the first transistor T1, the first transistor T1 is switched on, and the data voltage Vdata is written into the first node Na. At the same time, because the output terminal for outputting the n-th gate driving signal Sn is coupled to the control terminal of the second transistor T2, and the voltage at the second node Nb is at a low level last time, the second transistor T2 is switched on, the control terminal and the second terminal of the driving transistor are short-circuited, and thereby the driving transistor M functions as a diode. At this time, the voltage at the second node Nb changes to the first voltage plus a threshold voltage, i.e., VDD+Vth, where VDD is the first voltage and the Vth is the threshold voltage, i.e., a voltage enabling the driving transistor M to be conducted.

(3) Light Emitting Stage

Figure 8:
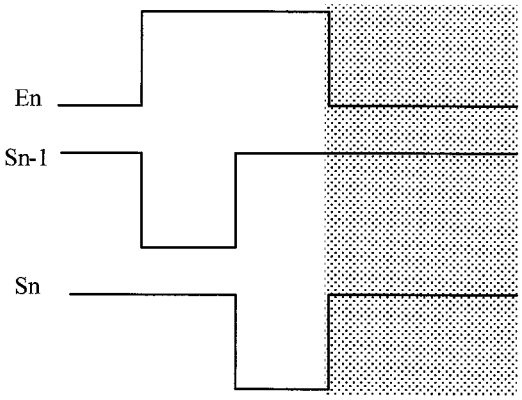
FIG. 8 is a waveform graph showing levels of the three switching signals in a light emitting stage.
Figure 9:
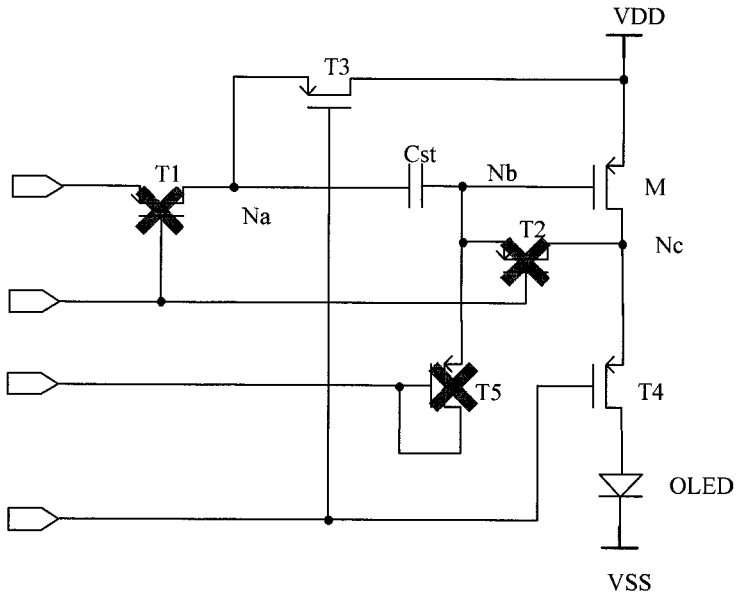
FIG. 9 is a schematic diagram showing on and off of transistors in a pixel compensation circuit in the light emitting stage.

As shown in FIG. 8, the levels of the three switching signals in FIG. 3 during this stage are indicated by shadow, and corresponding on/off states of individual transistors in the circuit in FIG. 2 are shown in FIG. 9.

In the light emitting stage, the n-th gate driving signal Sn and the (n−1)-th gate driving signal Sn-1 are at a high level. Because the output terminal for outputting the n-th gate driving signal Sn is coupled to the control terminals of the first and second transistors T1 and T2, the first and second transistors T1 and T2 are switched off. Because the output terminal for outputting the (n−1)-th gate driving signal Sn-1 is coupled to the control terminal of the fifth transistor T5, the fifth transistor T5 is switched off. In this stage, the enabling signal En is at a low level, and because the output terminal for outputting the enabling signal En is coupled to the control terminal of the third transistor T3, the third transistor T3 is switched on. The voltage at the first node Na is equal to the first voltage VDD, i.e., the voltage at the first node Na is at a high level at this time. Also, the voltage at the second node Nb is the first voltage plus the threshold voltage plus a difference between the first voltage and the data voltage, i.e., $V_{Nb}$=VDD+Vth+(VDD−Vdata), where VDD is the first voltage, Vth is the threshold voltage, i.e., the voltage for enabling the driving transistor M to be conducted, Vdata is the date voltage. Because the output terminal for outputting the enabling signal En is further coupled to the control terminal of the fourth transistor T4, the fourth transistor T4 is also switched on.

In the light emitting stage, the driving transistor M works at a saturation region, the working current of the driving transistor M is:

$$\begin{aligned} I_{OLED} &= 1/2C_{ox}uW/L(V_{GS}-Vth)^2 \\ &= 1/2C_{ox}uW/L(V_{Nb}-VDD-Vth)^2 \\ &= 1/2C_{ox}W/L(VDD+Vth+(VDD-Vdata)-VDD-Vth)^2 \\ &= 1/2C_{ox}uW/L(VDD-Vdata)^2 \end{aligned}$$

It can be seen that, the working current $I_{OLED}$ of the OLED is irrelevant to the threshold voltage Vth for enabling the driving transistor M to be conducted but only dependent on the difference between the first voltage VDD and the data voltage Vdata. Thus, the luminance of OLED is not inclined to be influenced by the threshold voltage Vth.

In view of the above, the pixel compensation circuit has an improved structure as compared with the conventional pixel compensation circuit. Thus, the light emitting current of the OLED is irrelevant to the threshold voltage of the driving transistor, and the direct influence of the shift of the threshold voltage on the luminance of the OLED is eliminated. Consequently, the present disclosure can prominently improve the display defects such as unevenness in image displaying due to nonuniformity in the threshold voltage for enabling the device to be conducted.

An embodiment of the present disclosure provides a pixel compensation circuit, including first to fifth switching elements, a storage capacitor, and a driving element.

Figure 10:
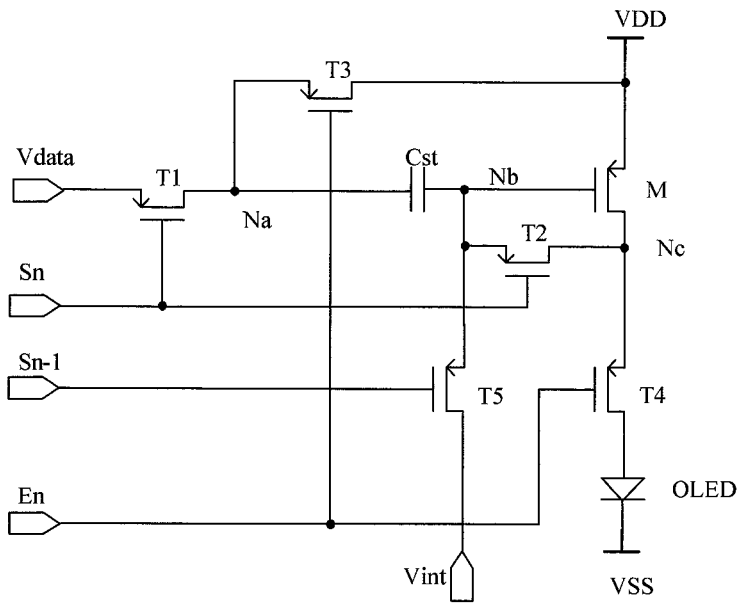
FIG. 10 is a schematic diagram showing a pixel compensation circuit according to another embodiment of the present disclosure.

FIG. 10 is a schematic diagram showing a pixel compensation circuit according to an embodiment of the present disclosure. The difference of the circuit in FIG. 10 from the circuit in FIG. 2 is that the fifth transistor T5 is a switching transistor and the second terminal (the drain) of the fifth transistor T5 is coupled to an initialization voltage Vint instead of being coupled to the control terminal of the fifth transistor T5 to serve as a diode. The connection relationships of other transistors are the same as that in the above embodiment.

The timing of the three switching signals provided to the circuit in FIG. 10 is as shown in FIG. 3, and similarly, the operation procedure of the pixel compensation circuit in FIG. 10 can be divided into an initialization stage, a threshold voltage shift stage and a light emitting stage. The on and off states of individual transistors in the pixel compensation circuit during the three stages are as shown in FIGS. 5, 7 and 9, and the above description regarding level changes in respective signals also apply to the circuit in FIG. 10 and thus repeated descriptions are omitted.

In the light emitting stage, the driving transistor M works at a saturation region, the working current of the driving transistor M is:

$$\begin{aligned} I_{OLED} &= 1/2C_{ox}uW/L(V_{GS}-Vth)^2 \\ &= 1/2C_{ox}uW/L(V_{Nb}-VDD-Vth)^2 \\ &= 1/2C_{ox}W/L(VDD+Vth+(VDD-Vdata)-VDD-Vth)^2 \\ &= 1/2C_{ox}uW/L(VDD-Vdata)^2 \end{aligned}$$

It can be seen that the working current $I_{OLED}$ in the embodiment is irrelevant to the threshold voltage Vth for enabling the driving transistor M to be conducted but only dependent on the difference between the first voltage VDD and the data voltage Vdata. Thus, the luminance of OLED is not inclined to be influenced by the threshold voltage Vth.

Further, because the first and second terminals of the fifth transistor T5 are coupled to the second node Nb and the initialization voltage Vint, respectively, the variations in the voltage at the second node Nb caused by the leakage of the fifth transistor T5 during the light emitting stage can be reduced by adjusting the voltage Vint, and thereby the stability of the voltage $V_{Nb}$ at the second node Nb is guaranteed.

In view of the above, the pixel compensation circuit has an improved structure as compared with the conventional pixel compensation circuit. Thus, the light emitting current of the OLED is irrelevant to the threshold voltage of the driving transistor, and the direct influence of the shift of the threshold voltage on the luminance of the OLED is eliminated. Consequently, the present disclosure can prominently improve the display defects such as unevenness in image displaying due to nonuniformity in the threshold voltage for enabling the device to be conducted.

An embodiment of the present disclosure further provides a display device, including an array substrate provided with a pixel compensation circuit thereon. The pixel compensation circuit may be the pixel compensation circuit according to any one of the above embodiments, and the specific structure of the pixel compensation circuit as mentioned above can be applied in the display device.

The display device can achieve the same technical effects as the above embodiments. Specifically, the direct influence of the shift of the threshold voltage on the luminance of the OLED can be eliminated, and consequently, the present disclosure can prominently improve the display defects such as unevenness in image displaying due to nonuniformity in the threshold voltage for enabling the device to be conducted.

One of ordinary skill in this art shall appreciate that modifications and alternations without departing from the scope and spirit of the present disclosure fall with the scope of the present disclosure as defined by the appended claims.

What is claimed is:

1. A pixel compensation circuit, comprising:

a first switching element having a control terminal coupled to an output terminal for outputting an n-th gate driving signal, a first terminal coupled to an output terminal for outputting a data voltage, and a second terminal coupled to a first node, wherein the n-th gate driving signal is configured to drive an n-th gate line;

a driving element having a control terminal coupled to a second node, a first terminal receiving a first voltage, and a second terminal coupled to a third node;

a storage capacitor coupled between the first node and the second node;

a second switching element having a control terminal coupled to the output terminal for outputting the n-th gate driving signal, a first terminal coupled to the second node, and a second terminal coupled to the third node;

a third switching element having a control terminal coupled to an output terminal for outputting an enabling signal, a first terminal receiving the first voltage, and a second terminal coupled to the first node;

a fourth switching element having a control terminal coupled to the output terminal for outputting the enabling signal, and a first terminal coupled to the third node; and a fifth switching element having a control terminal coupled to an output terminal for outputting an (n−1)-th gate driving signal, a first terminal coupled to the second node, and a second terminal receiving an initialization voltage which is adjustable to reduce variations in a voltage at the second node caused by leakage of the fifth switching element during a light emitting stage, wherein the (n−1)-th gate driving signal is configured to drive an (n−1)-th gate line, wherein n is a positive integer greater than 1.

2. The pixel compensation circuit according to claim 1, wherein the first to fifth switching elements are first to fifth transistors, respectively, and the driving element is a driving transistor.

3. The pixel compensation circuit according to claim 2, wherein the first to fifth transistors and the driving transistor are PMOS transistors.

4. The pixel compensation circuit according to claim 1, wherein, in an initialization stage:

the n-th gate driving signal and the enabling signal are at a high level, the first switching element, the second switching element, the third switching element and the fourth switching element are switched off, the (n−1)-th gate driving signal is at a low level, the fifth switching element is switched on, the second node is pulled to a low level, and the driving element is switched on.

5. The pixel compensation circuit according to claim 1, wherein, in a threshold voltage shift stage:

the enabling signal and the (n−1)-th gate driving signal are at a high level, the fifth switching element, the third switching element and the fourth switching element are switched off, the n-th gate driving signal is at a low level, the first switching element is switched on, the data voltage is written to the first node, the second switching element is switched on, the control terminal and the second terminal of the driving element are short-circuited, a voltage at the second node is the first voltage plus a threshold voltage, wherein the threshold voltage is a voltage enabling the driving element to be conducted.

6. The pixel compensation circuit according to claim 1, wherein, in a light emitting stage:

the n-th gate driving signal and the (n−1)-th gate driving signal are at a high level, the first switching element, the second switching element and the fifth switching element are switched off, the enabling signal is at a low level, the third switching element and the fourth switching element are switched on, a voltage at the first node is equal to the first voltage, a voltage at the second node is the first voltage plus a threshold voltage plus a difference between the first voltage and the data voltage, wherein the threshold voltage is a voltage enabling the driving element to be conducted.

7. A display device, comprising an array substrate provided with a pixel compensation circuit, comprising:

a first switching element having a control terminal coupled to an output terminal for outputting an n-th gate driving signal, a first terminal coupled to an output terminal for outputting a data voltage, and a second terminal coupled to a first node, wherein the n-th gate driving signal is configured to drive an n-th gate line;

a driving element having a control terminal coupled to a second node, a first terminal receiving a first voltage, and a second terminal coupled to a third node;

a storage capacitor coupled between the first node and the second node;

a second switching element having a control terminal coupled to the output terminal for outputting the n-th gate driving signal, a first terminal coupled to the second node, and a second terminal coupled to the third node;

a third switching element having a control terminal coupled to an output terminal for outputting an enabling signal, a first terminal coupled to the first voltage, and a second terminal coupled to the first node;

a fourth switching element having a control terminal coupled to the output terminal for outputting the enabling signal, and a first terminal coupled to the third node; and a fifth switching element having a control terminal coupled to an output terminal for outputting an (n−1)-th gate driving signal, a first terminal coupled to the second node, and a second terminal receiving an initialization voltage which is adjustable to reduce variations in a voltage at the second node caused by leakage of the fifth switching element during a light emitting stage, wherein the (n−1)-th gate driving signal is configured to drive an (n−1)-th gate line, wherein n is a positive integer greater than 1.

8. The display device according to claim 7, wherein the first to fifth switching elements are first to fifth transistors, respectively, and the driving element is a driving transistor.

9. A pixel compensation circuit, comprising:

a first switching element responsive to an n-th gate driving signal to transfer a data voltage to a first node, wherein the n-th gate driving signal is configured to drive an n-th gate line;

a driving element responsive to a voltage at a second node to transfer a first voltage to a third node;

a storage capacitor coupled between the first node and the second node;

a second switching element responsive to the n-th gate driving signal to change a voltage at the second node;

a third switching element responsive to an enabling signal to make the first voltage equal to a voltage at the first node;

a fourth switching element responsive to the enabling signal and coupled between the third node and an anode of an organic light emitting diode; and a fifth switching element responsive to an (n−1)-th gate driving signal, coupled to the second node and receiving an initialization voltage which is adjustable to reduce variations in a voltage at the second node caused by leakage of the fifth switching element during a light emitting stage, wherein the (n−1)-th gate driving signal is configured to drive an (n−1)-th gate line, wherein n is a positive integer greater than 1.

10. The pixel compensation circuit according to claim 9, wherein the organic light emitting diode has a cathode coupled to a second voltage.

11. The pixel compensation circuit according to claim 10, wherein the first voltage is a high level voltage and the second voltage is a low level voltage.

12. The pixel compensation circuit according to claim 10, wherein, in an initialization stage:

the n-th gate driving signal and the enabling signal are at a high level, the first switching element, the second switching element, the third switching element and the fourth switching element are switched off, the (n−1)-th gate driving signal is at a low level, the fifth switching element is switched on, the second node is pulled to a low level, and the driving element is switched on.

13. The pixel compensation circuit according to claim 12, wherein, in a threshold voltage shift stage:

the enabling signal and the (n−1)-th gate driving signal are at a high level, the fifth switching element, the third switching element and the fourth switching element are switched off, the n-th gate driving signal is at a low level, the first switching element is switched on, the data voltage is written to the first node, the second switching element is switched on, such that the driving element is short-circuited, a voltage at the second node is the first voltage plus a threshold voltage, wherein the threshold voltage is a voltage enabling the driving element to be conducted.

14. The pixel compensation circuit according to claim 13, wherein, in a light emitting stage:

the n-th gate driving signal and the (n−1)-th gate driving signal are at a high level, the first switching element, the second switching element and the fifth switching element are switched off, the enabling signal is at a low level, the third switching element and the fourth switching element are switched on, a voltage at the first node is equal to the first voltage, a voltage at the second node is the first voltage plus a threshold voltage plus a difference between the first voltage and the data voltage.

15. The pixel compensation circuit according to claim 9, wherein the first to fifth switching elements are first to fifth transistors, respectively, the driving element is a driving transistor, and the first to fifth transistors and the driving transistor are PMOS transistors.

* * * * *